United States Patent [19]

Schubart

[11] 4,133,626

[45] Jan. 9, 1979

[54] PRESS FOR PRESSING POTLIKE ARTICLES FROM CERAMIC POWDER

[75] Inventor: Rolf E. R. Schubart, Kochel am See, Fed. Rep. of Germany

[73] Assignees: Dorst-Keramikmaschinen-Bau Otto Dorst und Dipl.-Ing. Walter Schlegel, Kochel am See, Fed. Rep. of Germany

[21] Appl. No.: 824,268

[22] Filed: Aug. 15, 1977

[30] Foreign Application Priority Data

Aug. 18, 1976 [DE] Fed. Rep. of Germany ..... 2637231

[51] Int. Cl.[2] ..... B30B 5/02; B28B 3/00

[52] U.S. Cl. ..... 425/405 H; 425/417; 249/65

[58] Field of Search ..... 425/405 H, 47

[56] References Cited

U.S. PATENT DOCUMENTS

| | | | |
|---|---|---|---|
| 2,290,910 | 7/1942 | Jeffery | 425/405 H X |
| 2,449,407 | 9/1948 | Mulholland | 425/405 H |
| 3,034,191 | 5/1962 | Schaefer et al. | 425/405 H X |
| 3,239,591 | 3/1966 | Wendt | 425/405 H X |
| 3,588,080 | 6/1971 | Wallick | 425/405 H X |
| 3,594,877 | 10/1969 | Suda et al. | 425/405 H |
| 3,618,179 | 11/1971 | Anderson et al. | 425/405 H |
| 3,664,799 | 5/1972 | Wallick et al. | 425/405 H X |
| 4,043,724 | 8/1977 | Schubart | 425/47 X |
| 4,057,383 | 11/1977 | Bettonica | 425/405 H |

FOREIGN PATENT DOCUMENTS

| | | |
|---|---|---|
| 958393 | 9/1949 | France. |
| 2190046 | 1/1974 | France. |

*Primary Examiner*—J. Howard Flint, Jr.

*Attorney, Agent, or Firm*—Price, Heneveld, Huizenga & Cooper.

[57] ABSTRACT

A press is disclosed for forming and shaping from ceramic powder articles having a perimetrical leg-like portion. The press has an upper die and a lower mold, the latter having a central cavity closed at the top by a flexible membrane for receiving ceramic powder thereon. When the upper die closes on the mold, the membrane flexes to fit against the inside of the mold chamber. The mold chamber has flexible membrane walls which are forced inwardly by fluid pressure to shape and compress the perimetrical portions of the blank and upon release of the fluid pressure withdraw to permit removal of the finished blank.

7 Claims, 5 Drawing Figures

PRESS FOR PRESSING POTLIKE ARTICLES FROM CERAMIC POWDER

Figure 1:
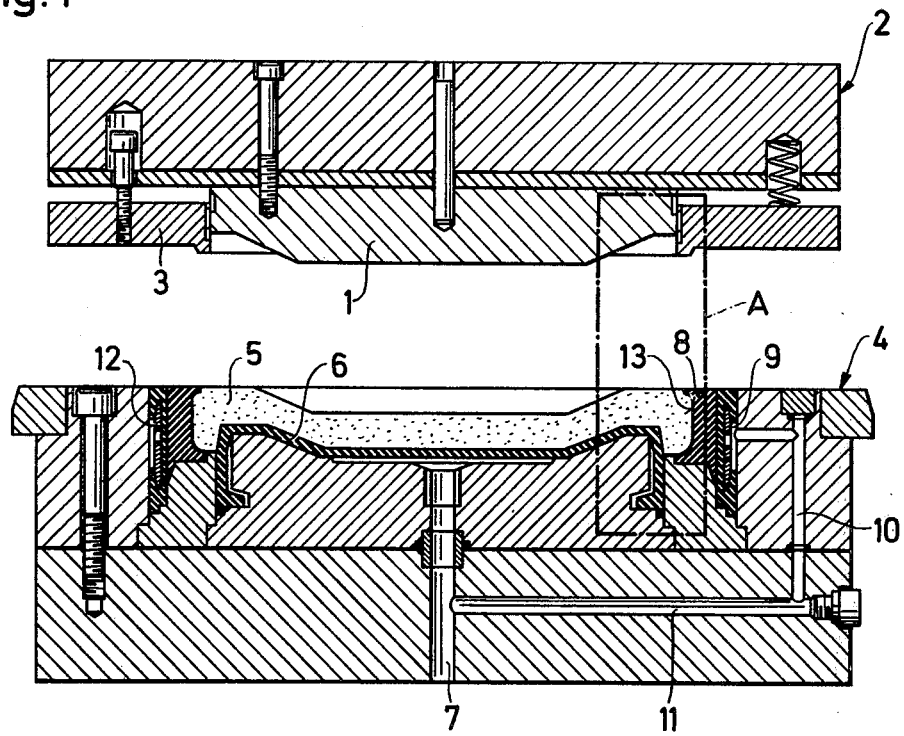

The invention relates to a press for pressing potlike articles from ceramic powder, said articles having a bottom and a side wall being substantially vertical. It starts from a press of this type consisting of a punching die shaping the outer surface of the bottom and a bottom-half mould being coated with an elastic membrane being pressurizable by a pressure medium as well as a self-contained casing defining the outer shape of the side wall. Such a press is e.g. known from the French Pat. No. 958 393.

A similar press, in which, however a bottom ram shapes the later outer surface of the bottom is revealed by the German DOS 1 808 144.

In the latter press the formation of an angle of incline at the upper edge of the side wall cannot be avoided when filling in the ceramic material and when flattening the same, so that a uniform thickness of the shaped article is not ensured upon the application of the pressure medium to the membrane. It is true that this problem is solved in the press according to the French Pat. No. 958 393, however, also here there is the problem of the removal of the pressed article from the mould. In both cases the pressed article must be shifted along the self-contained casing with the outer surface of its side wall, in particular, if articles of a very hard powdery material such as SiC are concerned, which leads to a rapid wear of the casing body. Besides this wear, there are of course considerable mechanical ejection forces which increase the power consumption of the machine in an undesired manner.

It is the object of the invention to design such a press in such a manner that the removal of the finish-pressed article is possible without difficulties, without there being the danger that the uniform thickness of the article gets lost.

This problem is solved according to the invention in that the casing consists of an elastically deformable casing and that a device is provided with which the casing can be pressurized towards the interior.

The casing is thus put into a prestressed state during the pressing process and at the end of the pressing process the tension is released with the membrane so that now sufficient free space for the finish-pressed article is formed, which can be removed from the press e.g. by means of a siphon. In an extremely simple manner the principle of the invention is realized by providing a ring channel communicating with the pressure medium source for the impingement of the membrane covering the bottom-half mould around the casing as a further development. Thus the casing consisting of elastic material is pressurized at the same time with this membrane and can move back into its initial position in the same way as the membrane after the letting off of the pressure, whereby the pressed article is released.

The ring channel is preferably designed as ring membrane being separated from the casing. This has the advantage that the casing which may be of the most simple design and which e.g. simply represents a circular ring, can be easily exchanged. It is the part being subjected to wear, whereas the ring channel only serves for the application of the pressure on the casing and the sealing of the whole system.

If the casing consists of a plastic material or caoutchouc with a high Shore hardness it can be recommendable, if, as a further development of the invention, the inner surface of the casing has a recess at the level of the side wall of the finished article. If the casing is pressurized by the pressure medium from the outside in case of such a construction, this recess is first of all regressed so that a smooth surface is formed against which the powder material being pressurized from the membrane covering the bottom-half mould rests. Upon the decrease of the pressure this recess if formed again and imparts sufficient clearance for the removal from the mould for the finished article.

The casing can also be made of steel, because steel is also an elastically deformable material. In this case the construction of such a recess is superfluous. The same applies of course to other metals or metal alloys having properties which are related to those of steel.

The drawings show in

Figure 1A:
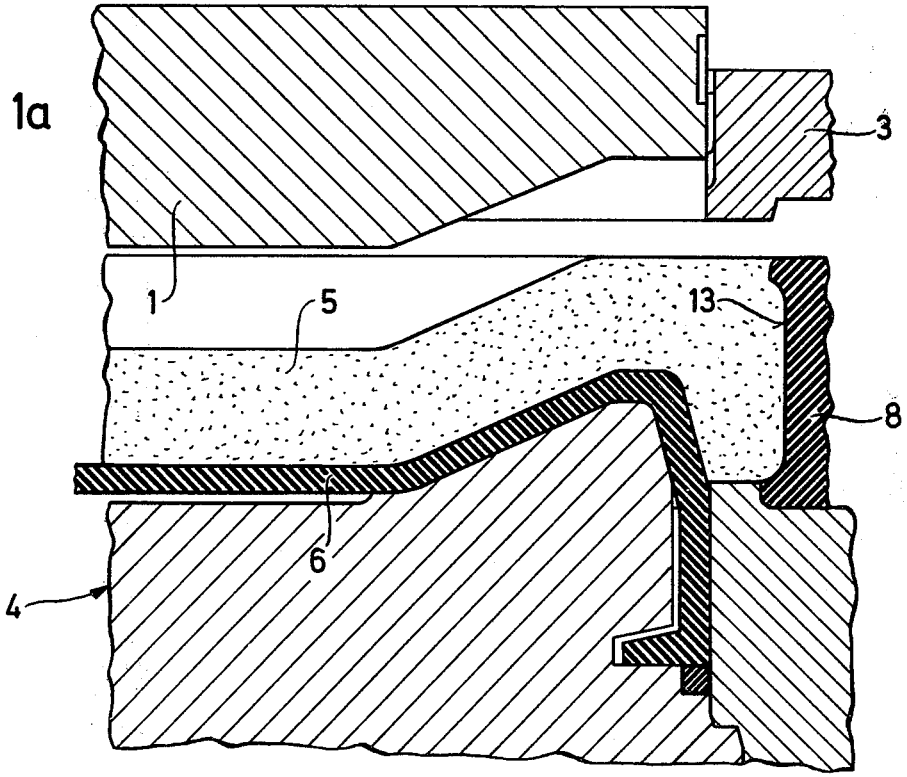
Figure 2:
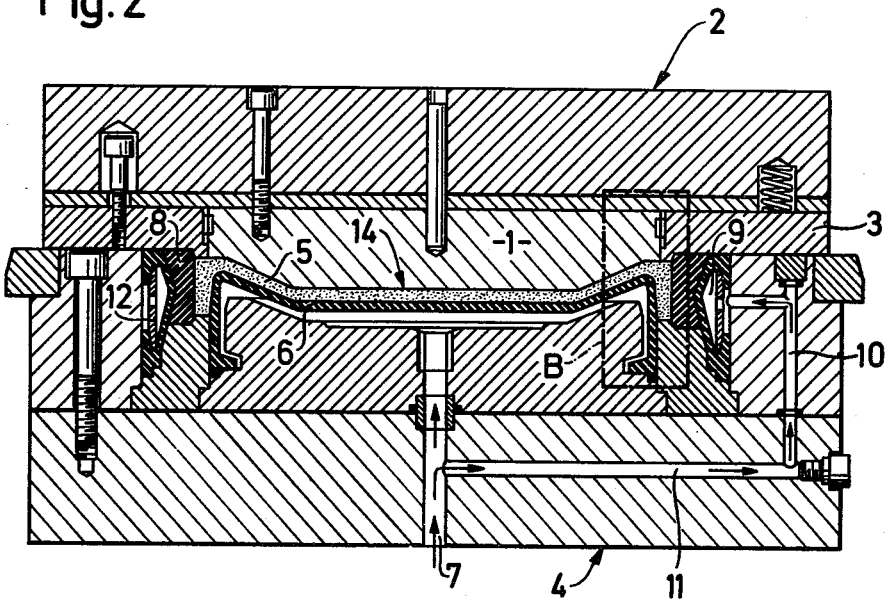
Figure 2A:
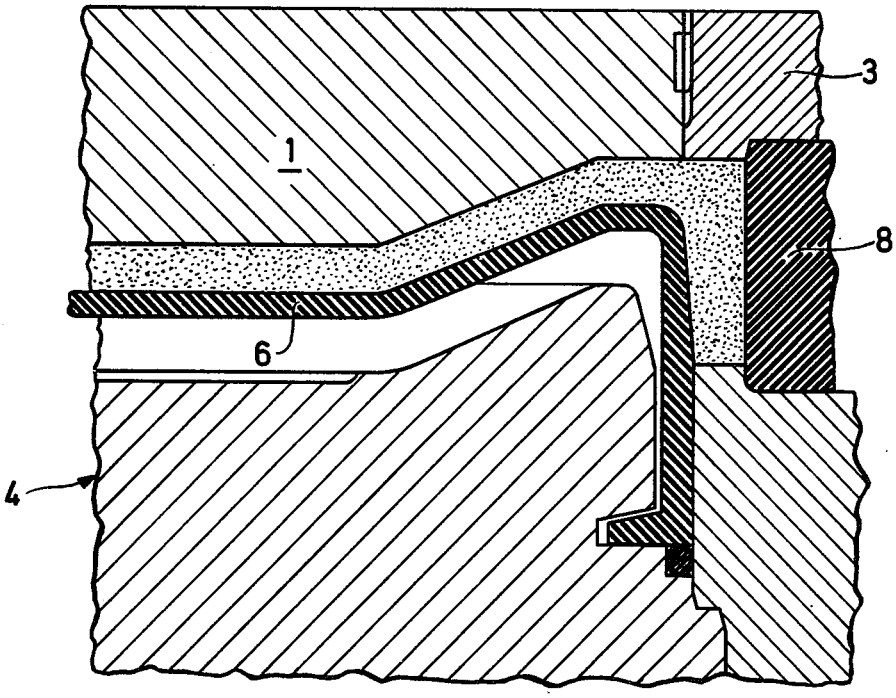

FIG. 1 a section through the punching die and the bottom-half mould of a press in the construction according to the invention, viz. in the filling position;

FIG. 1*a* a detail corresponding to the area A of FIG. 1;

FIG. 2 punching die and bottom-half mould of a press in the construction according to the invention in the pressing position;

FIG. 2*a* a detail corresponding to the area B of FIG. 2 and in

Figure 3:
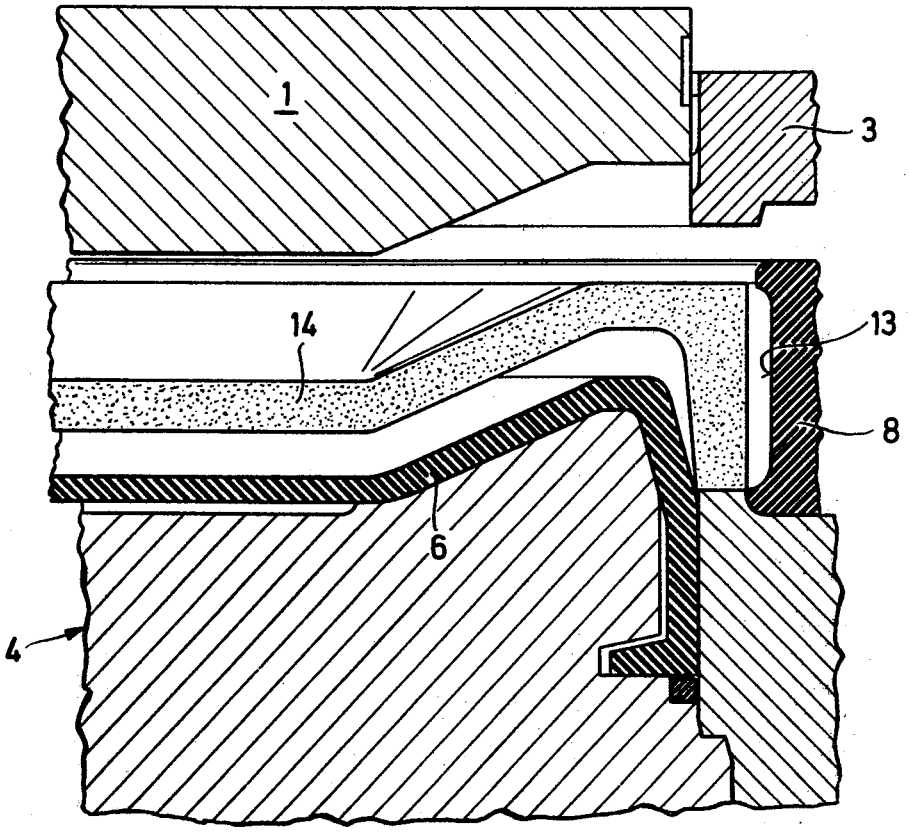

FIG. 3 the area B according to FIG. 2, but the press shortly before the removal of the finish-pressed article.

The moulding plate of the punching die generally designated with 2 is indicated with 1 in FIG. 1, which is surrounded by a spring-supported outer ring 3. The punching die 2 can be lowered to the stationary bottom-half mould 4 after the ceramic composition to be pressed has been filled in and correspondingly preprofiled. The bottom-half mould contains a membrane 6 being clearly recognizable in the detail in FIG. 1*a*. This membrane can be pressurized by a preferably liquid pressure medium through the line 7.

A casing 8 is moreover provided, which is surrounded by a ring channel 9 being communicating with the supply line for the pressure medium through line 10, 11. In the represented example of embodiment the ring channel consists of a membrane of a material similar to the material of the membrane 6 and is moreover kept open by a supporting body 12.

As can be seen from FIG. 1*a* the casing 8 has a recess 13 on its inner side. This recess is deformed upon the application of the pressure medium to form a straight surface so that the outer surface of the article is shaped correspondingly smoothly and straightly. It returns to its initial form after the letting off of the pressure so that the finished article is released without difficulties.

FIG. 2*a* shows the pressing position and also the disappeared recess at the casing 8. From FIG. 3 the reappearance of this recess 13 and also the fact that the finished article 14 is completely exposed and can be removed from the press without difficulties e.g. by means of a siphon after the removal of the punching die 2 can be gathered.

We claim:

1. A press for pressing pot-like articles from ceramic powder, said articles having a bottom and a vertical peripheral side wall extending substantially at right angles to said bottom, said press having a punch die forming one face of the body of the article and a lower mould having a central cavity; an elastic membrane dividing said central cavity into an upper moulding chamber and a lower pressure chamber; said punch die in one position adapted to close the top of said moulding chamber, said press characterized by an elastic annular casing surrounding said moulding chamber and spaced from said elastic membrane, a rigid element surrounding said casing; an annular pressure channel between said element and casing; a source of fluid under pressure connected to both said lower pressure chamber and said pressure channel for simultaneously forcing said casing inwardly toward said elastic membrane and said elastic membrane upwardly to shape and compact ceramic powder confined between in said moulding chamber said elastic membrane, casing and punch die.

2. The press as described in claim 1 further characterized by said casing having an inwardly facing recess in it's inner face; said annular pressure channel being outwardly aligned with said recess and said casing having a flexible web between said recess and said channel; said flexible web being inwardly movable when said pressure channel is pressurized to eliminate said recess.

3. The press as described in claim 1 further characterized by a ring member positioned between said rigid element and said casing and defines said annular pressure channel.

4. The press as described in claim 3 further characterized by the annular pressure channel being shaped to produce maximum inward deflection of the casing at approximately the vertical midpoint of the casing.

5. The press as described in claim 4 further characterized by a recess being provided in the inner face of the casing, said recess being eliminated by the inward movement of the outer wall of the recess when said pressure channel is under fluid pressure.

6. The press as described in claim 5 further characterized by the vertical height of said recess being the same as the height of the vertical peripheral side wall of the article being pressed.

7. A press as described in claim 6 further characterized in said casing having sufficient resilience and memory to return to it's original shape when not pressurized and thereby release the articles formed in said moulding chamber.

* * * * *